US007793700B2

(12) United States Patent
Bossler

(10) Patent No.: US 7,793,700 B2
(45) Date of Patent: Sep. 14, 2010

(54) WINDOW BLIND SAFETY DEVICE

(76) Inventor: Ronald Bossler, 33 Hillview Dr., Maurertown, VA (US) 22644

( * ) Notice: Subject to any disclaimer, the term of this patent is extended or adjusted under 35 U.S.C. 154(b) by 0 days.

(21) Appl. No.: 12/080,641

(22) Filed: Apr. 4, 2008

(65) Prior Publication Data

US 2009/0071610 A1 Mar. 19, 2009

(51) Int. Cl.
*E06B 9/30* (2006.01)
*E06B 9/388* (2006.01)

(52) U.S. Cl. ..... 160/173 R; 160/168.1

(58) Field of Classification Search ..... 160/107, 160/166.1, 168.1 R, 172 R, 173 R, 174 R, 160/177 R, 178.1 R, 178.2, 90
See application file for complete search history.

(56) References Cited

U.S. PATENT DOCUMENTS 3,123,130 A 3/1964 Fridlund
5,125,447 A * 6/1992 Suggs ..... 160/344
5,671,793 A * 9/1997 Lee ..... 160/168.1 R
5,676,188 A 10/1997 Cadorette
5,996,668 A * 12/1999 DeBlock et al. ..... 160/107
6,085,824 A 7/2000 Cadorette
6,463,987 B1 10/2002 Nevins
6,516,860 B1 2/2003 Weaver
6,601,633 B2 * 8/2003 Sun et al. ..... 160/107
6,644,374 B2 11/2003 Nien
6,792,995 B2 9/2004 Judkins
6,845,803 B1 1/2005 Nien
2003/0075285 A1 * 4/2003 Anderson et al. ..... 160/90
2004/0182523 A1 9/2004 McCarty

* cited by examiner

*Primary Examiner*—Katherine W Mitchell
*Assistant Examiner*—Jeremy C Ramsey
(74) *Attorney, Agent, or Firm*—Daniel L. Fitch; Wharton, Aldhizer & Weaver, PLC

(57) ABSTRACT

A window blind safety device that fully conceals the lift cords and continuously maintains tension on the lift cords located between the slats of the blind. The present invention comprises a back plate for mounting adjacent to a window; a slide movably attached to the back plate and fastened to the lift cords; a front cover attached to the back plate for concealing the lift cords, wherein the front cover comprises a longitudinal slot and a plurality of retaining notches, wherein the front cover is adapted for receiving the lift cords; a handle engaging the slide for adjusting the height of the blinds; and a shank fastener attached to the upper portion of the back plate.

11 Claims, 12 Drawing Sheets

WINDOW BLIND SAFETY DEVICE

CROSS REFERENCE TO RELATED APPLICATION

Not Applicable.

FEDERALLY SPONSORED RESEARCH

Not Applicable.

SEQUENCE LISTING PROGRAM

Not Applicable.

BACKGROUND

This invention relates in general to window blind safety devices. A window blind is generally comprised of a top rail, a bottom rail, a plurality of horizontal slats arranged in parallel between the top rail and the bottom rail, and a wheel lock located within the top rail which holds the lift cords in place when the blind is adjusted to the preferred height. The top rail has an opening through which the lift cords pass as they traverse through the top rail into the slats in the blind on their way down to the bottom rail, where they are attached. When the lift cord(s) are pulled down, the lift cords draw the bottom rail upward, allowing light in from outside. The lift cords pass through the opening in the top rail and pass directly over the wheel lock. When the lift cords are pulled to one direction the wheel lock engages and holds the lift cords in a fixed position. When the lift cords are pulled in the opposite direction the wheel lock disengages and the weight of the bottom rail pulls the lift cords up into the head rail, thus lowering the bottom rail and blocking incoming light. Because the lift cord(s) are exposed on the outside of the blinds, a child or pet could become tangled in the lift cord(s) and the result could be injury or death. In addition, the cords located between the slats of the window blind may be pulled out and pose a risk of injury or death to a child or pet.

Prior to 1994, the cord(s) for controlling window blinds terminated in a looped end. The looped end proved to be dangerous to children and pets. As a result, a number of blind manufacturers separated the lift cords and many window blinds now terminate in more than one cord. In addition, the lift cords located between the slats of the blinds are equally as dangerous to children and pets as they can be pulled out to form a loop. As a result, a number of blind manufacturers attached plastic beads to the upper portion of the lift cords, in an attempt to prevent the lift cords from being pulled out between the slats of the blinds. In addition, a number of blind manufacturers recommended cutting the lift cords close to the top rail, in order to keep the cords out of the reach of children and pets.

Information relevant to attempts to address these safety problems can be found in U.S. Pat. No. 6,463,987 (issued Oct. 15, 2002), U.S. Pat. No. 6,644,374 (issued Nov. 11, 2003), U.S. Pat. No. 5,676,188 (issued Oct. 14, 1997), U.S. Pat. No. 6,085,824 (issued Jul. 11, 2000), U.S. Pat. No. 3,123,130 (issued Mar. 3, 1964), U.S. Pat. No. 6,516,860 (issued Feb. 11, 2003), U.S. Pat. No. 6,792,995 (issued Sep. 21, 2004), U.S. Pat. No. 6,845,803 (issued Jan. 25, 2005), and U.S. Patent Application No. 2004/0182523 (published Sep. 23, 2004). However, each of these references suffers from one or more of the following disadvantages: 1) fails to work with blinds that have more than one lift cord; 2) is unable to continuously maintain tension on the lift cords located between the slats of the blinds, which are as dangerous as the lift cords that hang freely; 3) fails to fully conceal the lift cords that extend free from the top rail; 4) fails to recognize the added function and convenience of a wheel lock disabler.

The wheel lock is located within the head rail and functions to hold the lift cords in place when the blinds are adjusted by the user to the preferred height. When the wheel lock disabler is attached, as taught by the present disclosure, the lift cords move freely past the wheel lock and the blinds can be raised and lowered by raising and lowering the handle. This permits complete concealment of the lift cords within the present invention.

Despite these safety features, children and pets are still being injured by the tangled cords or by accidentally wrapping the loose cords around their necks. In addition, even when the cords are cut very short, children can still reach them by climbing onto objects like adjacent furniture. Accordingly, there is a need for improved safety devices, particularly to improve the safety of the lift cords and lift cords located between the slats of the blinds.

SUMMARY

The lift cords of blinds generally hang freely from the top rail and pose a danger to children and pets. In addition, the lift cords located within the slats of the blinds can be pulled out by a child or infant, which could result in their injury or death. In order to conceal the lift cords and continuously maintain tension on the lift cords located within the slats of the blinds, the present invention comprises a back plate for mounting adjacent to a window, a slide, a front cover, a handle and a shank fastener. Further, the slide of the present invention is movably attached to the back plate and fastened to the lift cords. The slide moves upward and downward inside the back plate, allowing the blinds to be raised and lowered. When the blinds are lowered, the slide draws the lift cords of the blind into the back plate for concealment. The front cover of the present invention is attached to the back plate for concealing the lift cords. The front cover comprises a longitudinal slot and a plurality of retaining notches. The front cover is adapted for receiving the lift cords, concealing the lift cords. The handle of the present invention engages the slide for adjusting the height of the blinds. The previously mentioned longitudinal slot within the front cover allows the handle and slide to move upward and downward within the device so that the blinds can be raised and lowered. The previously mentioned plurality of retaining notches within the front cover allow the handle of the present invention to engage the front cover, thus holding the blinds at the desired height. The shank fastener of the present invention is attached to the upper portion of the back plate. The shank fastener of an embodiment comprises at least two functions including securing the lift cords by wrapping them around the shank fastener, and acting as a roadblock for the slide so that the slide cannot be pulled outside the top of the device. Not all of the embodiments are required to provide either of the above functions.

An embodiment of the present invention further comprises a wheel lock disabler attached to the top rail of the window blind. The wheel lock disabler allows the blinds to be raised without the wheel lock engaging the lift cords.

An embodiment of the present invention further comprises a tube engaging the top rail of the window blind and engaging the top of the front cover, wherein the tube enshrouds the lift cords for concealing the lift cords between the top rail of the window blind and the top of the front cover.

An object of the present invention is to provide a window blind safety device that fully conceals the lift cords of a window blind. An embodiment of the present invention is able to fully conceal the lift cords because of a number of features including: 1) a front cover, which encloses the lift cords that hang freely; 2) a wheel lock disabler, which allows a user to raise and lower the blinds by moving the handle, without a need for contacting the lift cords themselves; 3) a tube, which fully enshrouds the lift cords that exit the top rail and enter into the front cover.

An object of the present invention is to increase the safety of window blinds that have more than one lift cord. The present invention functions on window blinds that have more than one lift cord as numerous lift cords can be fastened to the slide.

An object of the present invention is to maintain continuous tension on the lift cords located between the slats of the blinds, which are as dangerous as the lift cords that hang freely. An embodiment of the present invention is able to maintain tension on the lift cords because of a number of features including: 1) a shank fastener, which prevents the lift cords and slide from being pulled out of the top of the device, thus maintaining tension on the lift cords at all times; and 2) a handle engaging the retaining notches of the front cover and securing the window blinds at the desired height.

It is another object of the invention to provide a window blind safety device that can be retrofitted to any currently installed horizontal slat window blind. It is a further object of the invention to sell the device as a kit that can be retrofitted to separately purchased window blinds. It is a further object of the invention to have the kit packaged and sold along with window blinds. It is a further object of the invention to provide a window blind safety device that is inexpensive and easy to assemble and install.

DETAILED DESCRIPTION

Figure 1:
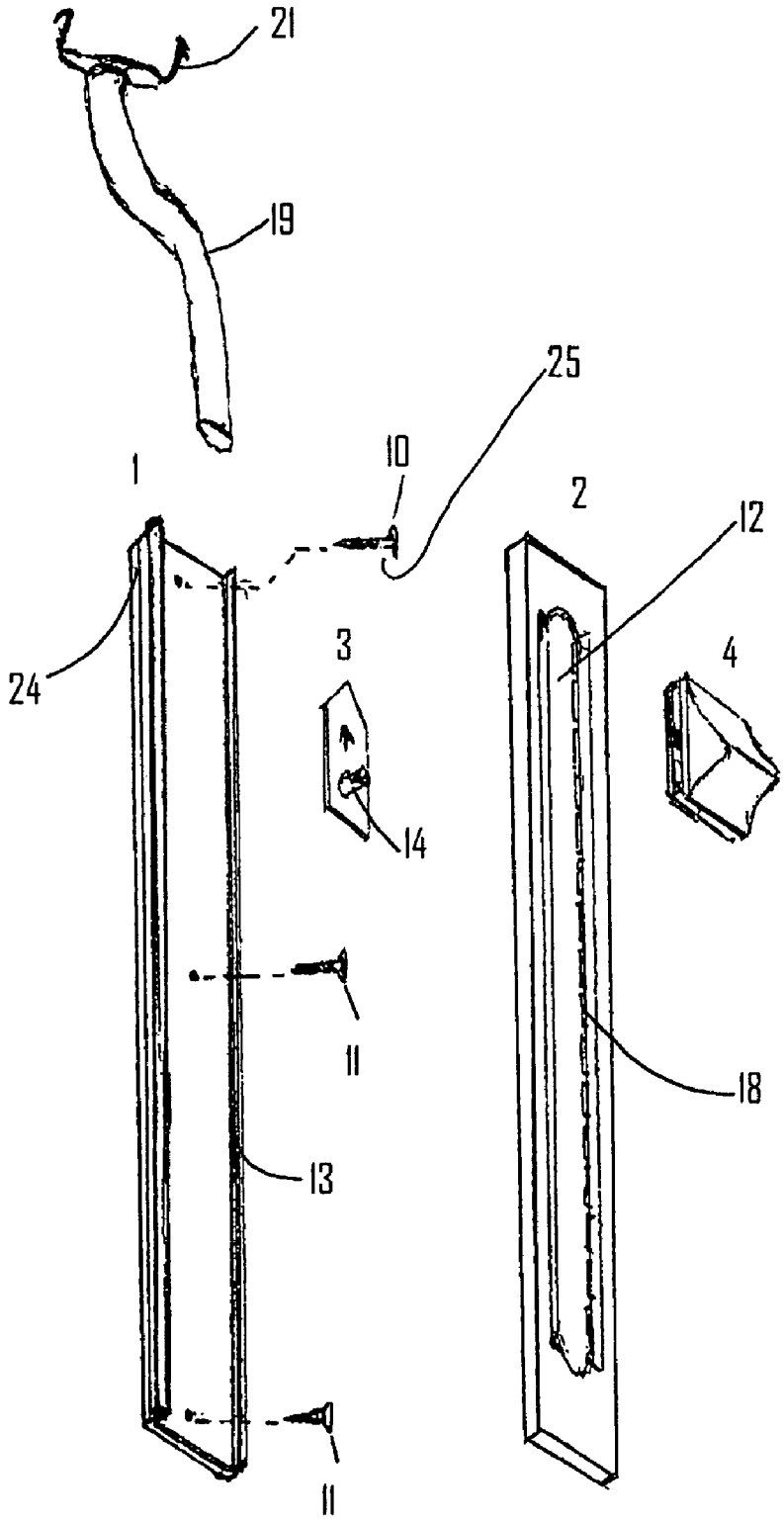
FIG. 1 is an isometric view of the preferred embodiment showing the back plate, shank fastener, slide, front cover, handle, wheel lock disabler and tube.

As shown in FIG. 1, the present invention comprises an apparatus mounted adjacent to a window for concealing and maintaining tension on one or more lift cords of a window blind comprising: a back plate 1; a slide 3; a front cover 2; a handle 4; and a shank fastener 10.

An embodiment of the present invention further comprises one or more of the following: a wheel lock disabler 21; and a tube 19.

Figure 3:
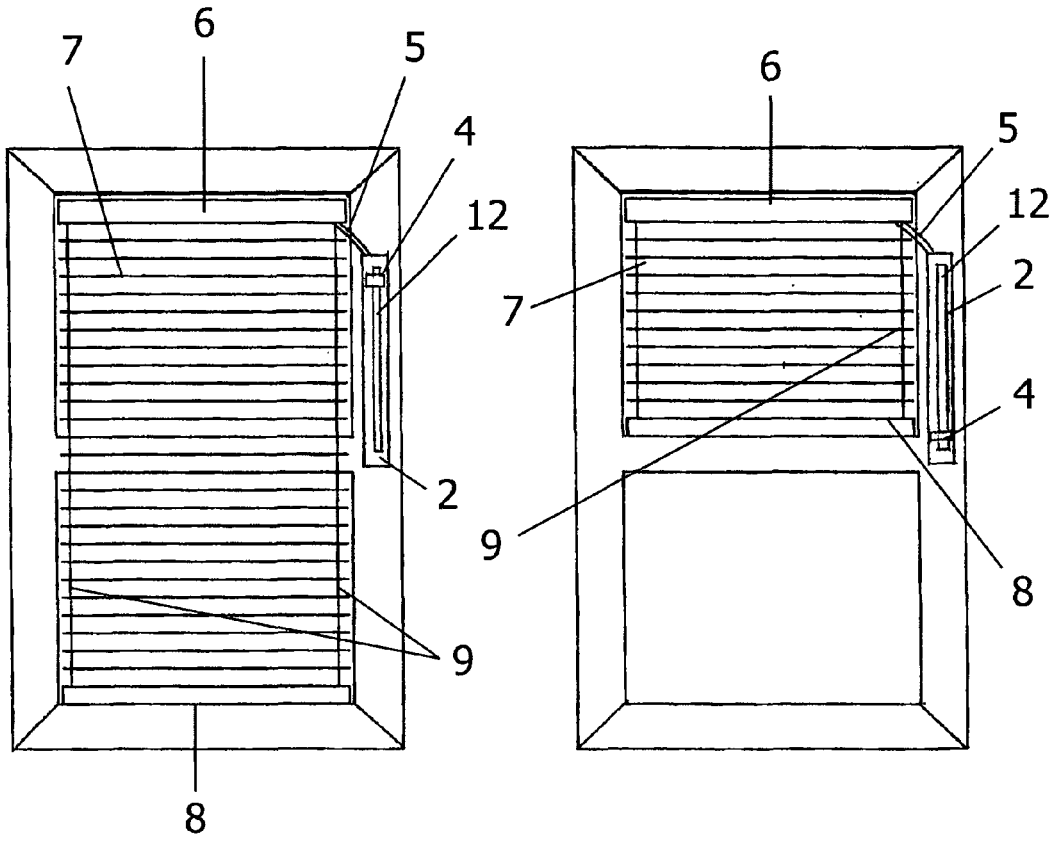
FIG. 3 is a dual schematic view of an embodiment retrofitted to a set of window blinds showing the window blinds fully extended and the window blinds drawn halfway up.

The present invention is a window blind safety device for mounting adjacent to a window, as shown in FIG. 3. The present invention conceals and maintains tension on the lift cords 5 of a window blind. The present invention functions on window blinds that have one or more lift cords 5.

Figure 4:
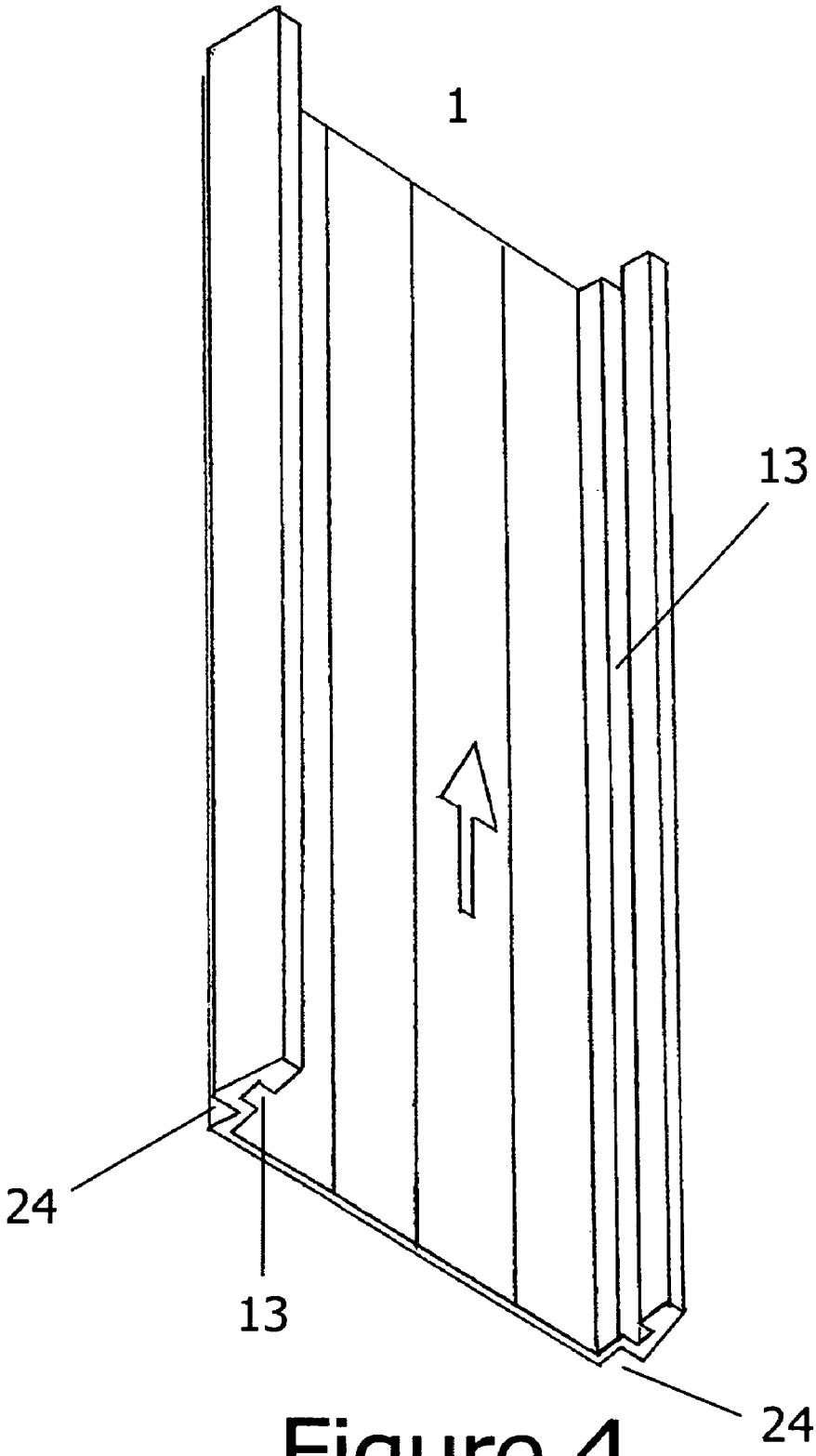
FIG. 4 is an isometric view of an embodiment of the back plate showing the longitudinal grooves for movably attaching the slide and the longitudinal depressions for attaching the front cover.

The present invention comprises a back plate 1 for mounting adjacent to a window, as shown in FIG. 3. The person of skill in the art could select a workable back plate 1 or create a workable back plate 1 by referring to FIG. 4. The back plate 1 is preferably wire molding, but may be constructed of other suitable materials, such as wood, aluminum, or vinyl. The back plate 1 of the preferred embodiment comprises longitudinal grooves 13, as shown in FIGS. 1 and 4, for movably attaching the slide 3. The back plate 1 of the preferred embodiment further comprises longitudinal depressions 24, as shown in FIGS. 1 and 4, for attaching the front cover 2.

Figure 5:
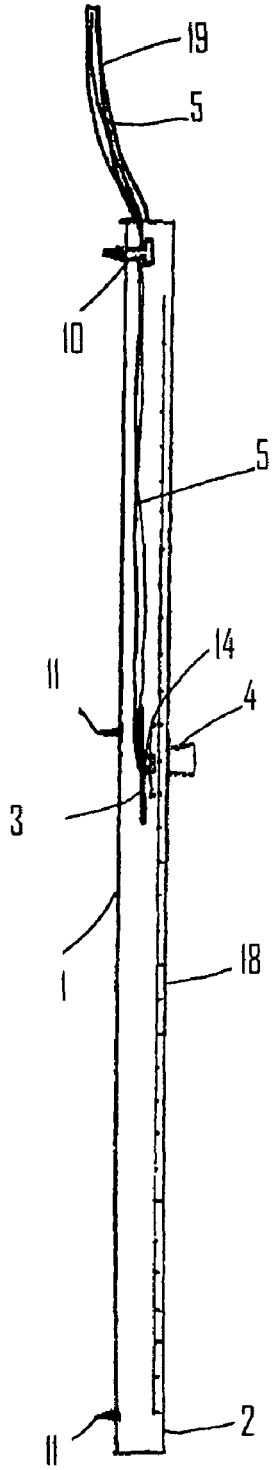
FIG. 5 is a side view cross section of an embodiment showing the path of the lift cords and the fastening of the lift cords to the slide.
Figure 6:
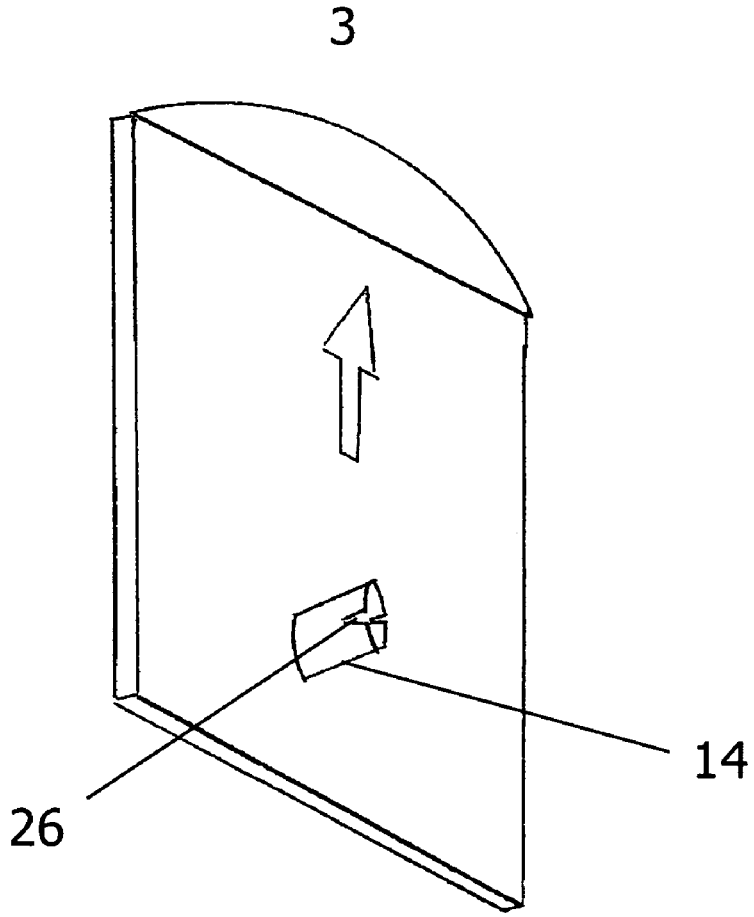
FIG. 6 is an isometric view of an embodiment of the slide showing a hollow knob extending outward and notches for fastening the lift cords.
Figure 7:
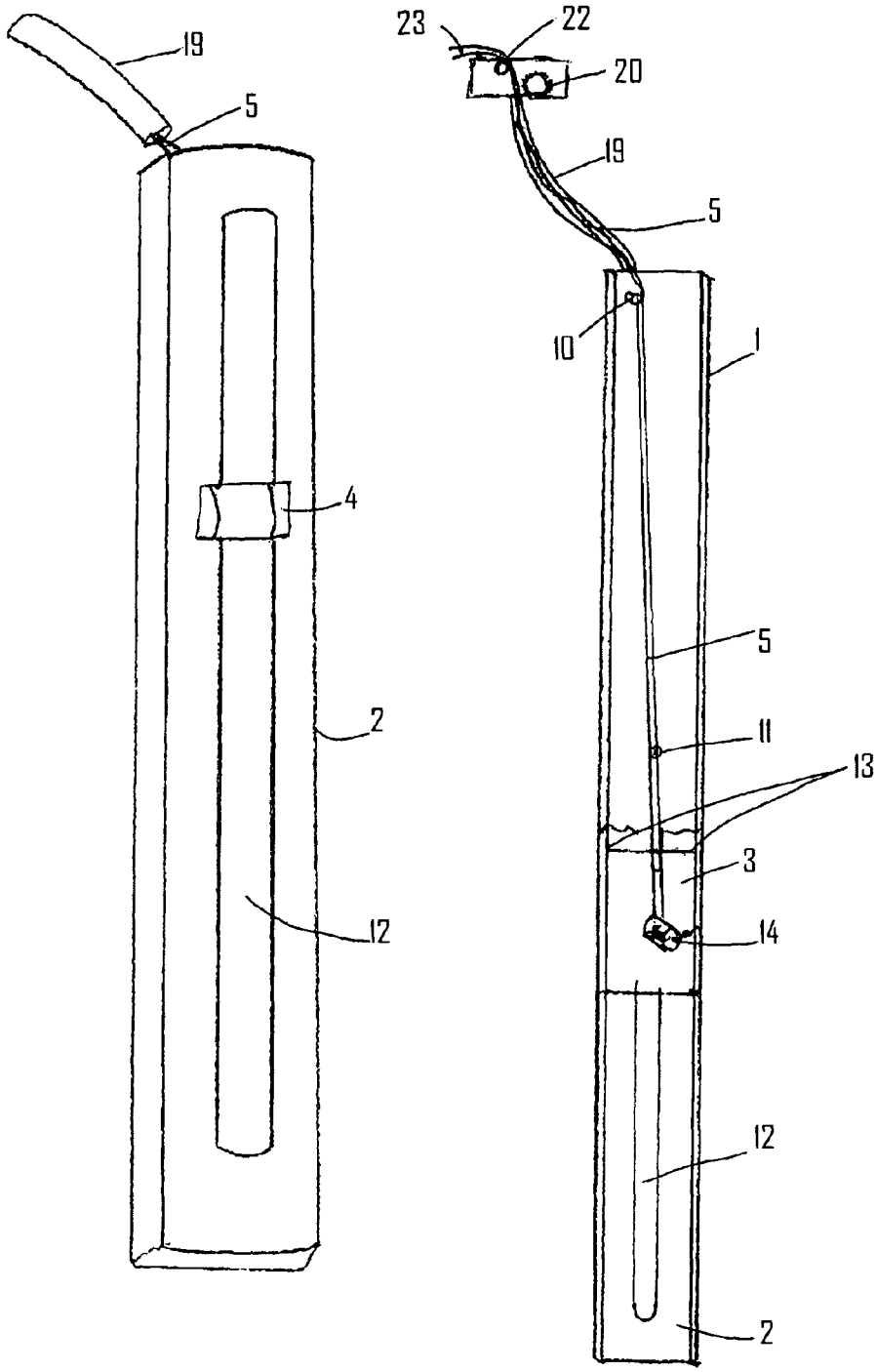
FIG. 7 is a dual schematic view of an embodiment showing the path of the lift cords and the shank fastener securing the lift cords.
Figure 8:
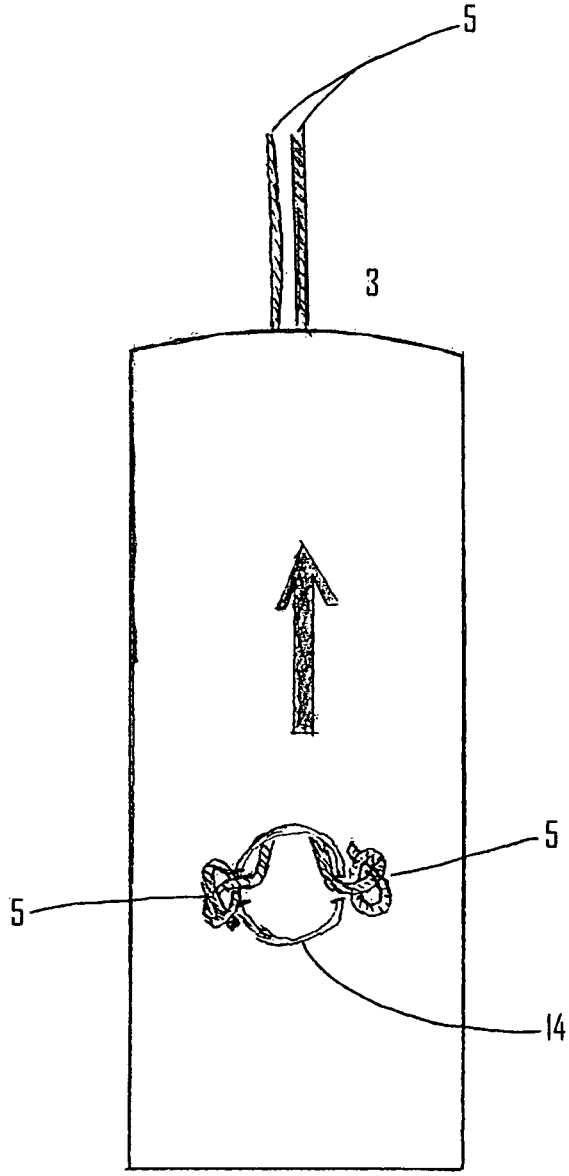
FIG. 8 is an enlarged view of an embodiment of the slide showing the lift cords passing through the hollow knob of the slide and the notches of the knob fastening the lift cords, wherein the lift cords are knotted in order to prevent them from slipping through the notches of the knob.

The present invention further comprises a slide 3 movably attached to the back plate 1 and fastened to the lift cords 5, as shown in FIGS. 5 and 7. The slide 3 of the preferred embodiment is positioned within the longitudinal grooves 13 of the back plate 1, as shown in FIGS. 1, 5, and 7. This positioning allows the slide 3 to move upward and downward within the back plate 1. The slide 3 of the preferred embodiment comprises a knob 14 extending outward, as shown in FIGS. 1, 2, 6 and 7. The knob 14 of the slide 3 is preferably hollow, which may allow the lift cords 5 to pass through, as shown in FIG. 8. The slide 3 preferably comprises a length that is approximately 1.5 times the width of the back plate 1, allowing for smooth movement within the back plate 1. The lift cords 5 of the window blind in the preferred embodiment are fastened to the slide 3, as shown in FIGS. 5, 7, and 8, by pulling the lift cords 5 through the hollow knob 14 of the slide 3 and securing the lift cords 5 within the notches 26. The notches 26 also allow the knob 14 to flex when the handle 4 is attached. By knotting the lift cords 5, as shown in FIG. 8, the lift cords 5 are less likely to slip through the notches 26 of the hollow knob 14 of the slide 3.

Figure 2:
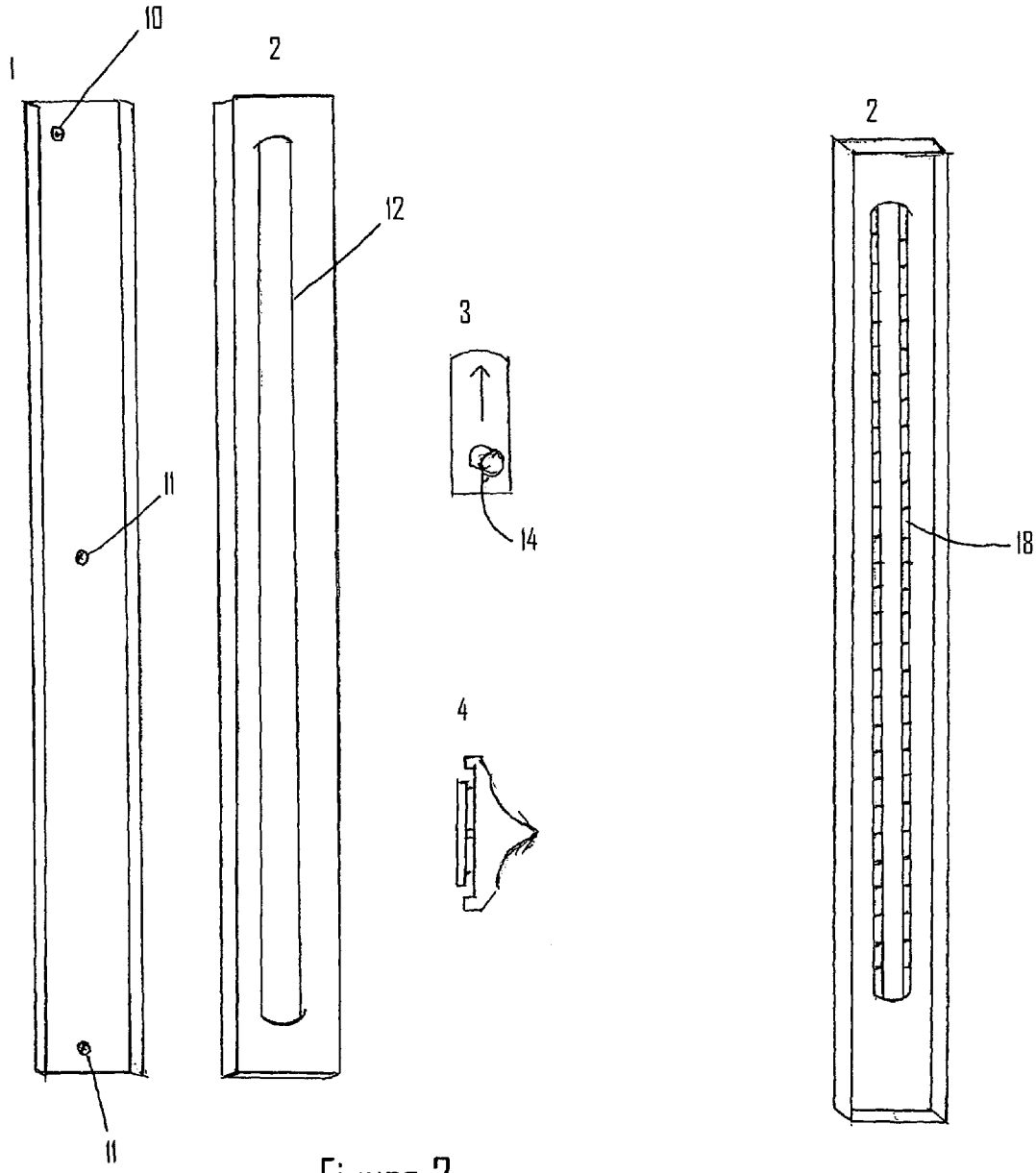
FIG. 2 is a schematic view of an embodiment showing the back plate, shank fastener, front cover, slide and handle, and a rear view of the front cover showing the retaining notches.

The present invention further comprises a front cover 2 attached to the back plate 1, as shown in FIGS. 5 and 7, for concealing the lift cords 5. The front cover 2 comprises a longitudinal slot 12, as shown in FIGS. 1, 2, 7, and 10. The longitudinal slot 12 of the front cover 2 preferably terminates prior to the top of the front cover 2, as shown in FIGS. 1, 2, and 7. This acts as another physical barrier that prevents the slide 3 from being pulled out of the top of the front cover 2 by either the weight of the blinds pulling on the lift cords 5 or a person pulling on the lift cords 9 located between the horizontal slats of the blinds. The result is that tension will remain on the lift ropes 9 that traverse through the slats of the blinds 7 to the bottom rail 8.

Figure 9:
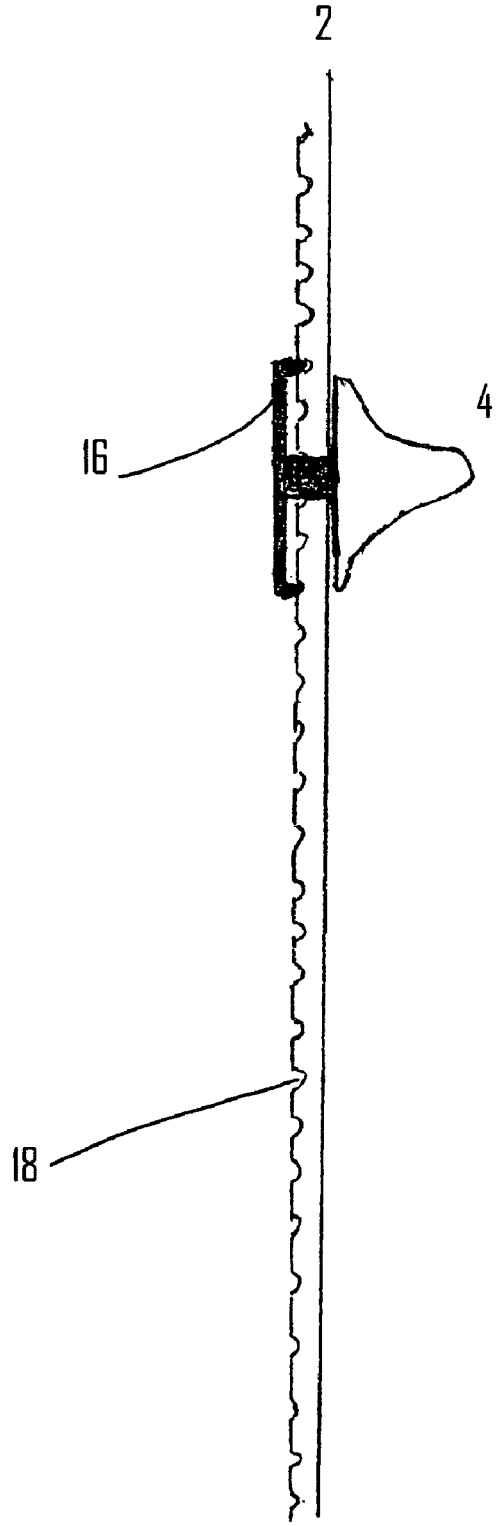
FIG. 9 is a side view of an embodiment of the front cover showing the two prongs of the handle engaging the retaining notches of the front cover.
Figure 10:
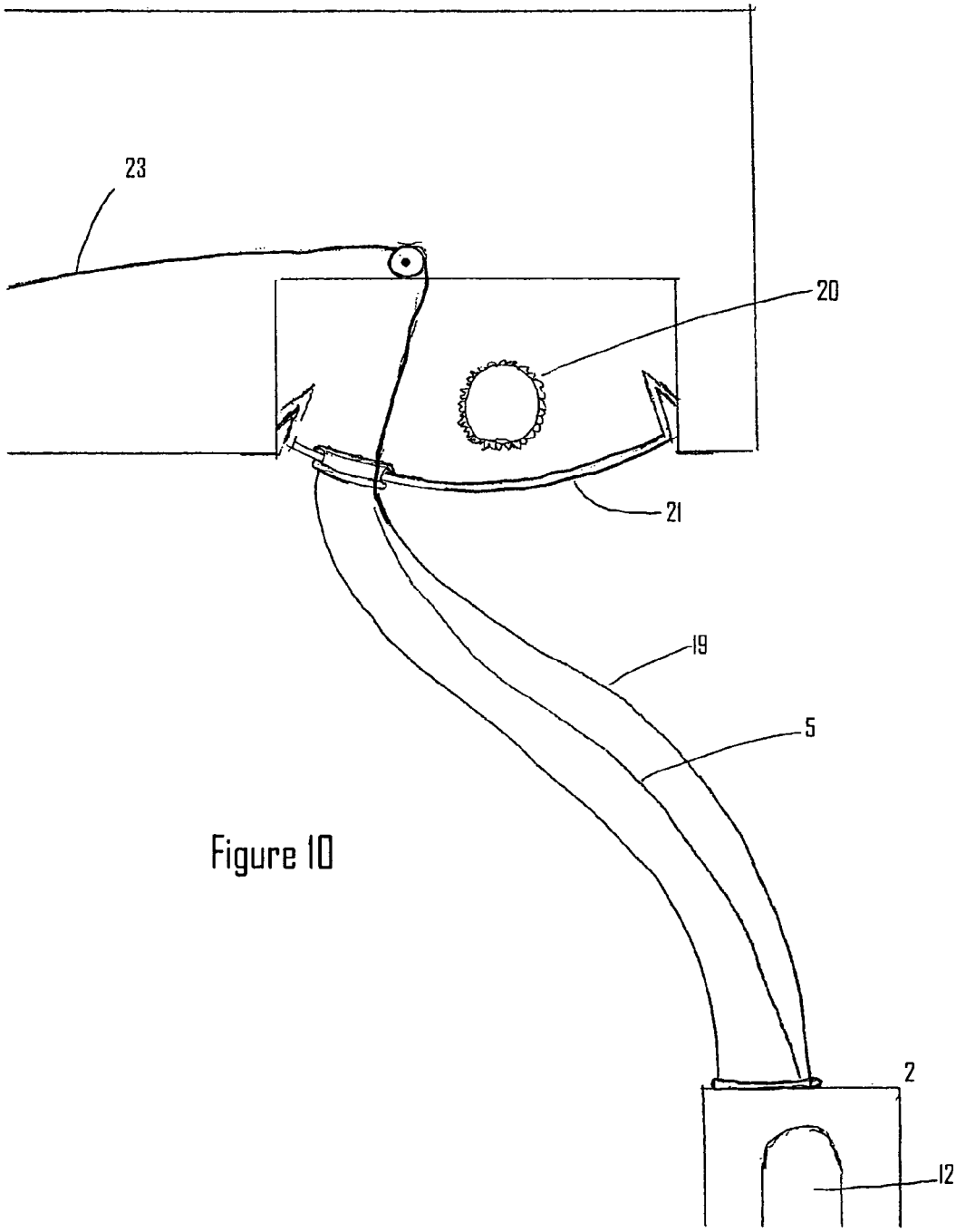
FIG. 10 is an enlarged view of an embodiment comprising the wheel lock disabler attached to the top rail for positioning the lift cords in order to prevent the lift cords from contacting the wheel lock and an embodiment comprising the tube overlapping the lift cords for concealing the lift cords between the top rail of the window blind and the top of the front cover, and showing the front cover adapted for receiving the lift cords.

The front cover 2 further comprises a plurality of retaining notches 18, as shown in FIGS. 1, 2 and 9. The front cover 2 is adapted for receiving the lift cords 5 of the window blind, as shown in FIGS. 7 and 10. The front cover 2 of the preferred embodiment comprises an opening at the top for receiving the lift cords 5 as shown in FIG. 10.

The front cover 2 of the preferred embodiment further comprises elongations for attaching to the longitudinal depressions 24 of the back plate 1. The elongations of the front cover 2 preferably allow the front cover 2 to attach to the back plate 1 by sliding over the back plate 1, wherein the elongations of the front cover 2 slide within the longitudinal depressions 24 of the back plate 1. Alternatively, the front cover 2 attaches to the back plate 1 by snapping onto the back plate 1, wherein the elongations of the front cover 2 snap into the longitudinal depressions 24 of the back plate 1.

The present invention further comprises a handle 4 engaging the slide 3 for adjusting the height of the blinds, as shown in FIG. 5. The preferred embodiment further comprises a handle 4 adapted for engaging the knob 14 of the slide 3, as shown in FIG. 5. The handle 4 of the preferred embodiment is further adapted for engaging the retaining notches 18 of the front cover 2, as shown in FIG. 9, for securing the window blinds at the desired height. The handle 4 of the preferred embodiment engages the knob 14 of the slide 3 for adjusting the height of the blinds, as shown in FIG. 5.

The present invention further comprises a shank fastener 10 attached to the upper portion of the back plate 1, as shown in FIGS. 1 and 7. The shank fastener 10 is for mounting the back plate 1 adjacent to a window, as shown in FIG. 3. The shank fastener 10 of the preferred embodiment is also for securing the lift cords 5, as shown in FIG. 7. The shank fastener 10 is preferably selected from the group consisting of a shank screw and a double headed screw, but may be selected from the group of fasteners that accomplish at least one of the functions of the shank fastener. The shank fastener 10 of the preferred embodiment also prevents the slide 3 from being pulled out of the top of the back plate 1 by either the weight of the blinds pulling on the lift cords 5 or a person pulling on the lift cords located between the horizontal slats of the blinds 9. The benefit of the shank fastener 10 is that it both prevents the lift cords 5 from being pulled past the shank fastener 10 and blocks the path of the slide 3, so that the slide 3 cannot be pulled out of the top of the back plate 1. This is a benefit over the prior attempts, as tension will remain on the lift cords 9 that travel through the slats of the blinds 7 to the bottom rail 8. This prevents the lift cords 9 from being pulled out from between the slats of the window blind 7.

In a further embodiment of the present invention the back plate 1 and front cover 2 are joined into one piece.

A further embodiment of the present invention comprises a front cover 2, wherein the front cover 2 comprises a rigid material for securing the handle 4 in the retaining notches 18. The rigid material reinforces the front cover 2 in order to secure the handle 4 in the retaining notches 18 when an embodiment of the present invention is used with heavy window blinds, such as those made of wood. The person of skill in the art could select a suitable rigid material without undue experimentation. The front cover 2 of the further embodiment is preferably made of plastic, wood or metal. The front cover 2 of a further embodiment comprises a rib adjacent to the longitudinal slot 12 for securing the handle in the retaining notches 18. The rib reinforces the front cover 2 in order to secure the handle 4 in the retaining notches 18 when an embodiment of the present invention is used with heavy window blinds again, such as those made of wood. The rib is preferably formed by creating an angle of approximately 45 degrees in the front cover 2 adjacent to the longitudinal slot 12.

Figure 12:
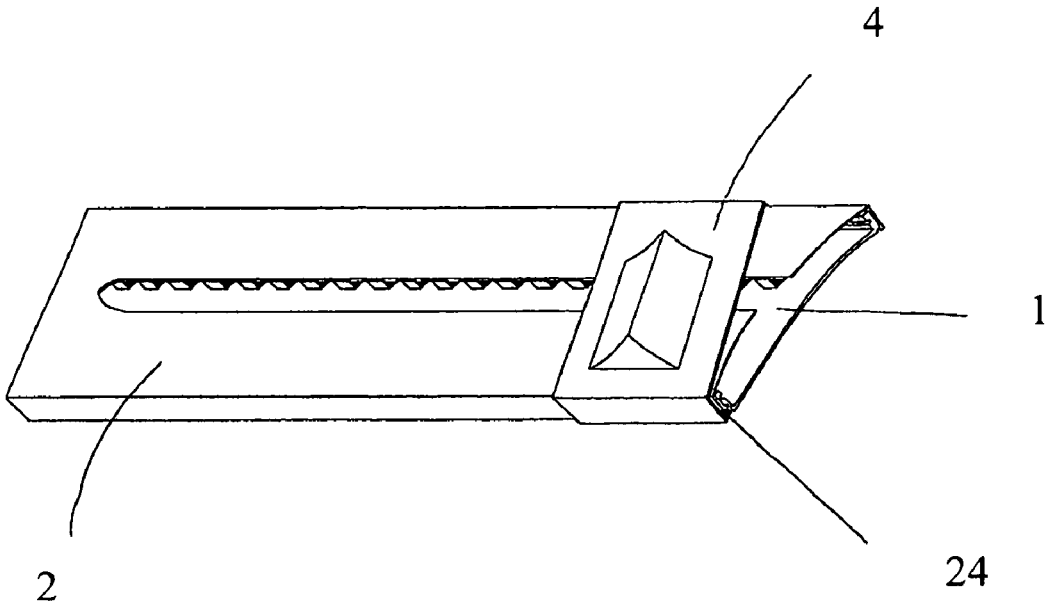
FIG. 12 is an isometric view of an embodiment comprising a handle with elongations for attaching to the longitudinal depressions of the back plate to reinforce the front cover.

The handle 4 of a further embodiment comprises a first and second piece, the first piece 16 is adapted for engaging the retaining notches 18 of the front cover 2, as shown in FIG. 9, and the second piece is adapted for engaging the knob 14 of slide 3. A further embodiment of the present invention comprises a handle 4, wherein the first piece 16 of the handle 4 comprises a spring loaded device for engaging and disengaging the retaining notches 18 of the front cover 2. As shown in FIG. 12, a further embodiment of the present invention comprises a handle 4, wherein the handle 4 comprises elongations for attaching to the longitudinal depressions 24 of the back plate 1 for reinforcing the front plate 2. The elongations of the handle 4 wrap around the front plate 2 attaching to the longitudinal depressions 24 of the back plate 1. The elongations of the handle 4 assist in securing the handle 4 in the retaining notches 18 when the present invention is used with heavy window blinds, such as those made of wood.

Figure 11:
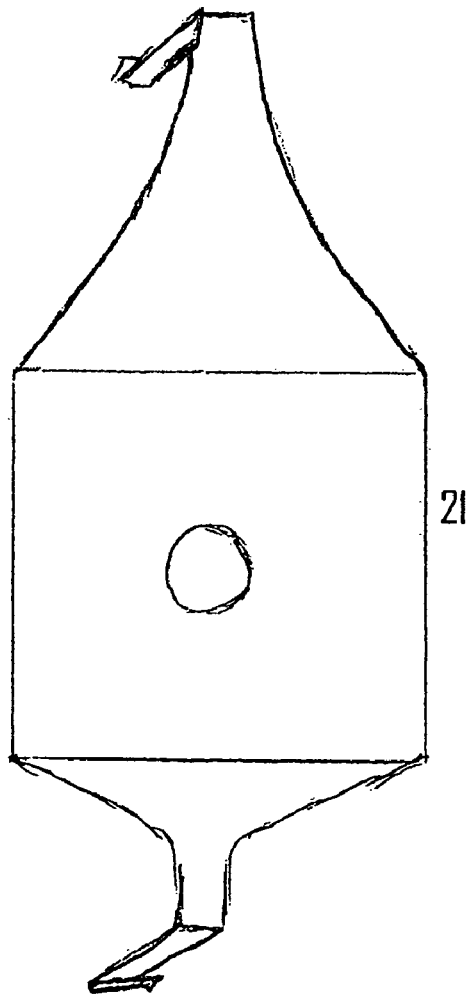
FIG. 11 is an isometric view of an embodiment comprising the wheel lock disabler showing the hole off center for positioning the lift cords in order to prevent the lift cords from contacting the wheel lock.

A further embodiment of the present invention comprises a wheel lock disabler 21, as shown in FIGS. 10 and 11, attached to the top rail 6 of the window blind, as shown in FIG. 10. A person of skill in the art would be able to make a wheel lock disabler 21 without undue experimentation by referring to FIGS. 10 and 11. The wheel lock disabler 21 of a further embodiment, as shown in FIGS. 10 and 11, comprises a hole off center for positioning the lift cords 5 in order to prevent the lift cords 5 from contacting the wheel lock 20, as shown in FIG. 10. The wheel lock disabler 21 of a further embodiment comprises a rigid material in order to maintain its position despite the lateral force of the lift cords 5. The person of skill in the art could select a suitable rigid material without undue experimentation. The wheel lock disabler 21 of the further embodiment is preferably made of plastic, wood or metal. The wheel lock disabler 21 of a further embodiment positions the wheel lock 20 so that it does not contact the lift cords 5, instead of positioning the lift cords 5 themselves.

A further embodiment of the present invention comprises a tube 19 engaging the top rail of the window blind 6 and further engaging the top of the front cover 2, wherein the tube enshrouds the lift cords 5 for concealing the lift cords 5 between the top rail of the window blind 6 and the top of the front cover 2, as shown in FIGS. 1, 7 and 10.

A further embodiment of the present invention comprises a back plate 1 for mounting adjacent to a window, the back plate 1 comprising longitudinal grooves 13, the back plate further comprising longitudinal depressions 24; a slide 3 movably attached in the longitudinal grooves 13 of the back plate 1, the slide 3 is fastened to the lift cords 5, the slide 3 comprising a knob 14 extending outward; a front cover 2 attached to the back plate 1 for concealing the lift cords, the front cover comprising a longitudinal slot 12, the front cover 2 adapted for receiving the lift cords 5, the front cover 2 comprising elongations for attaching to the longitudinal depressions 24 of the back plate 1; a handle 4 adapted for engaging the knob 14 of the slide 3, the handle 4 adapted for engaging the retaining notches of the front cover; a shank fastener 10 attached to the upper portion of the back plate 1, the shank fastener 10 comprising a portion without threads 25; a motor attached to the bottom of the back plate 1; a switch attached to the motor for activating the motor; a winch attached to the motor; a cord having a first and second end, wherein the first end is attached to the winch, the cord wherein the second end is attached to the slide for the motor when activated to adjust the height of the blinds.

Embodiments of the present invention are able to continuously maintain tension on the lift cords because of a number of features, including 1) the longitudinal slot 12 of the front cover terminates prior to the top of the front cover 2; 2) the presence of a shank fastener 10, 3) the length of the longitudinal slot 12 of the front cover. The longitudinal slot 12 of the front cover terminates prior to the top of the front cover 2. The result is the movement of the handle 4 and slide 3 to which the lift cords 5 are fastened is limited. Even if the blinds are lowered all the way down to rest on the window sill, there still remains tension on the lift cords between the slats of the blind 9. The tension exists as the lift cords 5 are secured at the top of the front cover 2. The lift cords 9 are pulled tight between the bottom rail 8 and the slide 3 located at the top of the front cover 2; therefore, there is no slack. If a child pulls on the lift cords between the slats of the blind 9, the weight of the bottom rail 8 will act as resistance. The present invention comprises a shank fastener 10 attached to the top of the back plate 1 for securing the lift cords 5. The lift cords 5 of an embodiment are wrapped around the shank fastener 10, therefore, the lift cords 5 cannot be drawn above the back plate 1. In addition, the shank fastener 10 attached at the top of the back plate 1 prevents the slide 3 from being pulled out of the top of the back plate 1. The full length of the longitudinal slot 12 is less than the length of a fully extended window blind. The result is that when the slide 3 and handle 4 are pushed to the top of the longitudinal slot 12, tension remains on the lift cords 9 that are located between the slats of the blind.

The present invention is able to fully conceal the lift cords that extend free from the top rail as the front cover 2 conceals the lift cords 5 and an embodiment comprises a tube 19 to conceal the lift cords 5 between the top of the front cover 2 and the top rail 6 of the window blind.

In addition, the prior attempts fail entirely to recognize the added function and convenience of a wheel lock disabler 21. The wheel lock 20 is located within the head rail 6 and functions to hold the lift cords 5 in place when the blinds are adjusted by the user to the preferred height. When the wheel lock disabler 21 is attached, as taught by the present invention, the lift cords 5 move freely past the wheel lock 20 and the blinds can be raised and lowered by raising and lowering the handle 4. This permits the lift cords 5 to be completely concealed within the present invention.

An embodiment of the present invention is sold as a kit.

ADVANTAGES

From the description above, a number of advantages of the window blind safety device become evident:

1. The present invention is effective on window blinds with one or more lift cords.

2. The present invention fully conceals the lift cords of a window blind and continuously maintains tension on the lift cords located between the slats of the blind.

3. The present invention provides a wheel lock disabler, which allows the disclosed device to fully conceal the lift cords as there is no need to contact the lift cords to raise and lower the blinds.

4. The present invention provides a window blind safety device that can be retrofitted to any horizontal slat window blind.

5. The present invention provides a window blind safety device that is inexpensive and easy to assemble and install.

6. The present invention has added safety features that protect children and pets. For example, if a child is able to pull the front cover off of the device, the slide will be pulled directly upward by the weight of the blinds, however, the shank screw will prevent the slide from being drawn past the top of the back plate. The result is that tension will remain on the lift cords located in the slats of the blind.

7. The present invention provides a structure for fully concealing the lift cords that pass from the head rail to the top of the front plate.

It is not necessary for every embodiment of the present invention to incorporate every advantage.

Although preferred and further embodiments have been depicted and described in detail herein, it will be apparent to those skilled in the relevant art that various modifications, additions, substitutions, and the like can be made without departing from the teaching of the invention and these are therefore considered to be within the scope of the invention as defined in the following claims.

What is claimed is:

1. An apparatus mounted adjacent to a window which conceals and maintains tension on one or more lift cords of a window blind comprising:

a back plate mounted adjacent to a window;

a slide movably attached directly to the back plate and fastened to the lift cords;

a front cover attached to the back plate concealing the lift cords, wherein the front cover comprises a longitudinal slot and a plurality of retaining notches spaced at intervals on its interior surface matched to the dimensions of a handle, wherein the alignment of each notch is generally perpendicular to and traverses across both sides of said longitudinal slot, wherein the front cover receives the lift cords;

a handle, separate from the movable slide, wherein said handle engages the slide and is dimensionally adapted to engage both an upper and lower retaining notch at a plurality of intervals, comprising a spring-loaded lock and slide mechanism which adjusts the height of the blinds and secures the window blinds at the desired height;

a shank fastener attached to the upper left portion of the back plate, which shank fastener extends outward.

2. The apparatus of claim 1, wherein the back plate and front cover are joined into one piece.

3. The apparatus of claim 1, further comprising a wheel lock disabler attached to the exterior of the window blind, separate from an internal braking mechanism of the blind, which wheel lock disabler comprises an off-center hole for positioning the lift cords in order to prevent the lift cords from contacting the wheel lock.

4. The apparatus of claim 3, further comprising a tube engaging the window blind and engaging the top of the front cover, wherein the tube enshrouds the lift cords for concealing the lift cords between the window blind and the top of the front cover.

5. The apparatus of claim 1, wherein the back plate comprises longitudinal grooves movably attaching the slide.

6. The apparatus of claim 1, wherein the back plate comprises longitudinal depressions for attaching the front cover.

7. The apparatus of claim 1, wherein the slide comprises a knob extending outward, wherein the knob of the slide is hollow allowing the lift cords to pass through, wherein the knob of the slide comprises notches engaging knots at the end of the lift cords.

8. The apparatus of claim 1, wherein the handle comprises separate first and second pieces, wherein the first piece engages the retaining notches of the front cover, wherein the second piece engages the knob of the slide.

9. The apparatus of claim 6, wherein the handle comprises elongations for attaching to the longitudinal depressions of the back plate for reinforcing the front plate and securing the handle in the retaining notches.

10. An apparatus mounted adjacent to a window which conceals and maintains tension on one or more lift cords of a window blind comprising:

a back plate mounted adjacent to a window, a slide movably attached directly to the back plate and fastened to the lift cords;

a front cover attached to the back plate concealing the lift cords, wherein the front cover comprises a longitudinal slot and a plurality of retaining notches spaced at intervals on its interior surface matched to the dimensions of a handle, wherein the alignment of each notch is generally perpendicular to and traverses across both sides of said longitudinal slot, wherein the front cover receives the lift cords;

a handle, separate from the movable slide, wherein said handle engages the slide and is dimensionally adapted to engage both an upper and lower retaining notch at a plurality of intervals, comprising a spring-loaded lock and slide mechanism which adjusts the height of the blinds and secures the window blinds at the desired height;

a shank fastener attached to the upper left portion of the back plate, which shank fastener extends outward;

a wheel lock disabler attached to the exterior of the window blind, separate from an internal braking mechanism of the blind, which wheel lock disabler comprises and off-center hole positioning the lift cords in order to prevent the lift cords from contacting the wheel lock;

a tube engaging the window blind and engaging the top of the front cover, wherein the tube enshrouds the lift cords concealing the lift cords between the window blind and the top of the front cover.

11. A kit mounted adjacent to a window for concealing and maintaining tension on one or more lift cords of a window blind comprising:

a back plate for mounting adjacent to a window, a slide movably attached directly to the back plate and fastened to the lift cords;

a front cover attached to the back plate for concealing the lift cords, wherein the front cover comprises a longitudinal slot and a plurality of retaining notches spaced at intervals on its interior surface matched to the dimensions of a handle, wherein the alignment of each notch is generally perpendicular to and traverses across both sides of said longitudinal slot, wherein the front cover receives the lift cords;

a handle, separate from the movable slide, wherein said handle engages the slide and is dimensionally adapted to engage both an upper and lower retaining notch at a plurality of intervals, comprising a spring-loaded lock and slide mechanism which adjusts the height of the blinds and securing the window blinds at the desired height;

a shank fastener attached to the upper left portion of the back plate, which shank fastener extends outward.

* * * * *